US008944454B2

(12) United States Patent
Blauch et al.

(10) Patent No.: US 8,944,454 B2
(45) Date of Patent: Feb. 3, 2015

(54) DUAL-TRACK TILT MECHANISM

(75) Inventors: Corey Blauch, Dunmore, PA (US); James Patrick Mulhern, Nanticoke, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 1023 days.

(21) Appl. No.: 12/243,606

(22) Filed: Oct. 1, 2008

(65) Prior Publication Data

US 2009/0085324 A1 Apr. 2, 2009

Related U.S. Application Data

(60) Provisional application No. 60/976,751, filed on Oct. 1, 2007.

(51) Int. Cl.
*A61G 5/10* (2006.01)
*A47C 1/027* (2006.01)

(52) U.S. Cl.
CPC ..... *A61G 5/1075* (2013.01); *A47C 1/027* (2013.01); *A61G 5/107* (2013.01)
USPC ..... 280/304.1; 297/325; 297/344.1

(58) Field of Classification Search
CPC ..... A61G 5/1075; A61G 5/104; A61G 5/107; A47C 1/024; A47C 1/027
USPC ..... 280/250.1, 304.1, 767; 297/325, 329, 297/344.1, 344.14, DIG. 4, 354.1, 322
See application file for complete search history.

(56) References Cited

U.S. PATENT DOCUMENTS

| | | | | | |
|---|---|---|---|---|---|
| 144,603 | A * | 11/1873 | Enger | 297/329 |
| 465,719 | A * | 12/1891 | Mitchell | 297/329 |
| 2,153,763 | A * | 4/1939 | Kuhler | 297/329 |
| 2,245,713 | A * | 6/1941 | Redmond | 248/395 |
| 5,603,551 | A * | 2/1997 | Sheehan | 297/329 |
| 5,785,384 | A * | 7/1998 | Sagstuen | 297/317 |
| 6,050,642 | A * | 4/2000 | Erb | 297/322 |
| 6,206,393 | B1 * | 3/2001 | Mascari et al. | 280/220 |
| 7,007,965 | B2 | 3/2006 | Bernatsky et al. | |
| 7,090,240 | B2 * | 8/2006 | Papac | 280/647 |
| 8,474,848 | B2 | 7/2013 | Bernatsky et al. | |

* cited by examiner

*Primary Examiner* — Anne Marie Boehler
(74) *Attorney, Agent, or Firm* — Baker Hostetler LLP

(57) ABSTRACT

The present invention is directed to a tilt-in-space wheelchair that limits the shift of the center of a gravity of a wheelchair occupant during tilting. The wheelchair comprises a main frame adapted to be supported on a surface by wheels, a seat frame for supporting a occupant, and an arc plate for slidably or rollably supporting the seat frame with respect to the main frame. The arc plate defines a first track and a second track that guide the tilting of the seat frame relative to the frame. The first track and second track may have non-constant curvatures. Further, the first track and second track may be arranged non-concentrically on the arc plate and may have different lengths.

16 Claims, 4 Drawing Sheets

DUAL-TRACK TILT MECHANISM

RELATED APPLICATION

This application claims the benefit of provisional patent application No. 60/976,751, filed Oct. 1, 2007; the entire disclosure of which is incorporated by reference.

TECHNOLOGY FIELD

The present invention is generally directed to a wheelchair. More particularly, the present invention is directed to a tilt-in-space wheelchair.

BACKGROUND

The pressure from sitting in a single position for an extended period of time cuts off circulation to vulnerable parts of the body. As a result, patients who are bound to a wheelchair for extended periods of time may develop pressure sores or pressure ulcers. Tilt-in-space wheelchairs have been developed to transfer pressure from the seat surface to the back surface by tilting or reclining a seated patient. While conventional tilt-in-space wheelchairs are effective at shifting weight and pressure for patients who cannot otherwise do so, they are deficient in other ways. For example, some tilt-in-space wheelchairs may cause sudden shifts in the center of gravity of a seated patient. A sudden shift in the center of gravity of a patient may produce a falling sensation and a startle reflex as a result. Startle reflex may cause hypertonia in some patients, which is characterized by increased tightness of muscle tone that may lead to loss of function and deformity.

U.S. Pat. No. 7,007,965 is directed to a tilt-in-space wheelchair having a seat supported relative to a base by a rocker that has a constant curvature and is designed to maintain the center of gravity of a wheelchair occupant at a fixed location during tilting. In order for the center of gravity of the wheelchair occupant to remain at a fixed location during tilting, however, the focal point of the curve of the rocker must coincide with the center of gravity of the wheelchair occupant. Because different wheelchair occupants may have different centers of gravity that may not be easily determined, the wheelchair may need significant adjustments to ensure that the focal point of the curve of the rocker coincides with the center of gravity of the wheelchair occupant.

SUMMARY

This Summary is provided to introduce a selection of concepts in a simplified form that are further described below in the Detailed Description of Illustrative Embodiments. This Summary is not intended to identify key features or essential features of the invention, nor is it intended to be used to limit the scope of the invention.

The present invention is directed to a tilt-in-space wheelchair that limits the shift of the center of a gravity of a wheelchair occupant during tilting. The wheelchair comprises a main frame adapted to be supported on a surface by wheels, a seat frame for supporting a occupant, and an arc plate for slidably or rollably supporting the seat frame with respect to the main frame. The arc plate defines a first track and a second track that guide the tilting of the seat frame relative to the frame. According to one embodiment, the first track and second track have non-constant curvatures. Further, the first track and second track may be arranged non-concentrically on the arc plate and may have different lengths. According to another embodiment, the first track and second track preferably have constant curvatures and are arranged non-concentrically on the arc plate. Further, the constant curvatures of the first track and second track may be different and the lengths of the first track and second track may also be different.

According to another aspect of the invention, the arc plate may be connected to the seat frame and the first track and second track rest on rollers or slides that are disposed on a support plate connected to the main frame. Thus, the seat frame and arc plate may move relative to the main frame. In another embodiment, the arc plate is connected to the main frame and the seat frame is connected to a support plate having rollers or slides that engage the first track and second track of the arc plate. Thus, the seat frame may move relative to the arc plate connected to the main frame.

Additional features and advantages will be made apparent from the following detailed description of illustrative embodiments that proceeds with reference to the accompanying drawings.

BRIEF DESCRIPTION OF THE DRAWINGS

The foregoing summary, as well as the following detailed description, is better understood when read in conjunction with the appended drawings. For the purpose of illustrating the reconstruction device and related method thereof, there is shown in the drawings exemplary embodiments; however, the wheelchair is not limited to the specific embodiments disclosed.

DETAILED DESCRIPTION OF ILLUSTRATIVE EMBODIMENTS

Figure 1:
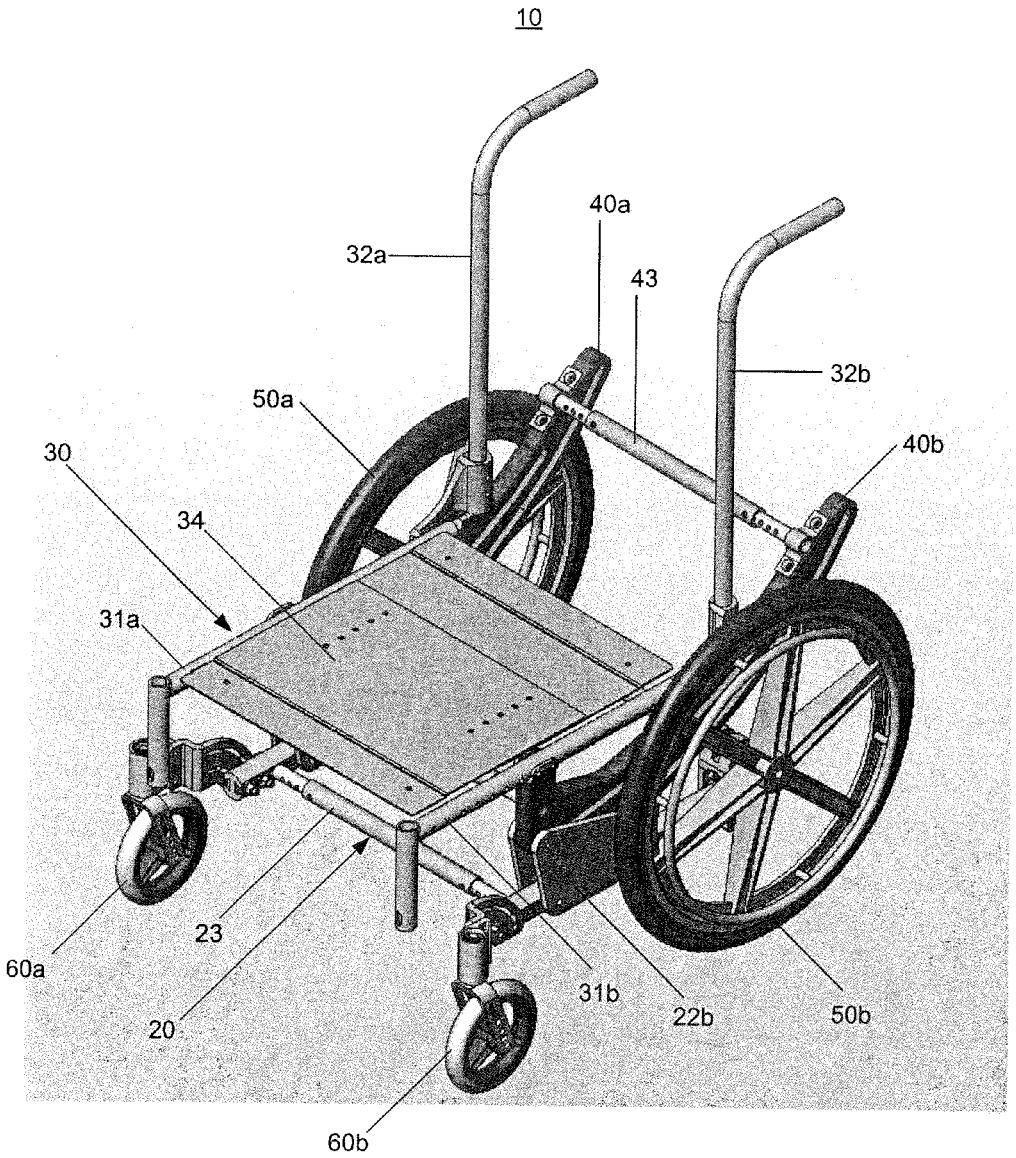
FIG. 1 shows an perspective view of an exemplary dual-track, tilt-in-space wheelchair with portions of the wheelchair removed for clarity.

A dual-track, tilt-in-space wheelchair 10 allows tilting of an occupant while limiting shifting of the center of gravity of the occupant. As shown in FIG. 1, the wheelchair 10 may comprise a main frame 20, a seat frame 30, arc plates 40*a*, 40*b*, wheels 50*a*, 50*b*, and caster wheels 60*a*, 60*b*. The main frame 20 is supported on a surface by wheels 50*a*, 50*b*, and caster wheels 60*a*, 60*b*. The seat frame 30 is supported on the main frame 20 by arc plates 40*a*, 40*b* such that the seat frame 30 may be tilted relative to the main frame 20. Thus, an occupant supported by the seat frame 30 may be reclined by tilting the seat frame 30 relative to the main frame 20.

Figure 2A:
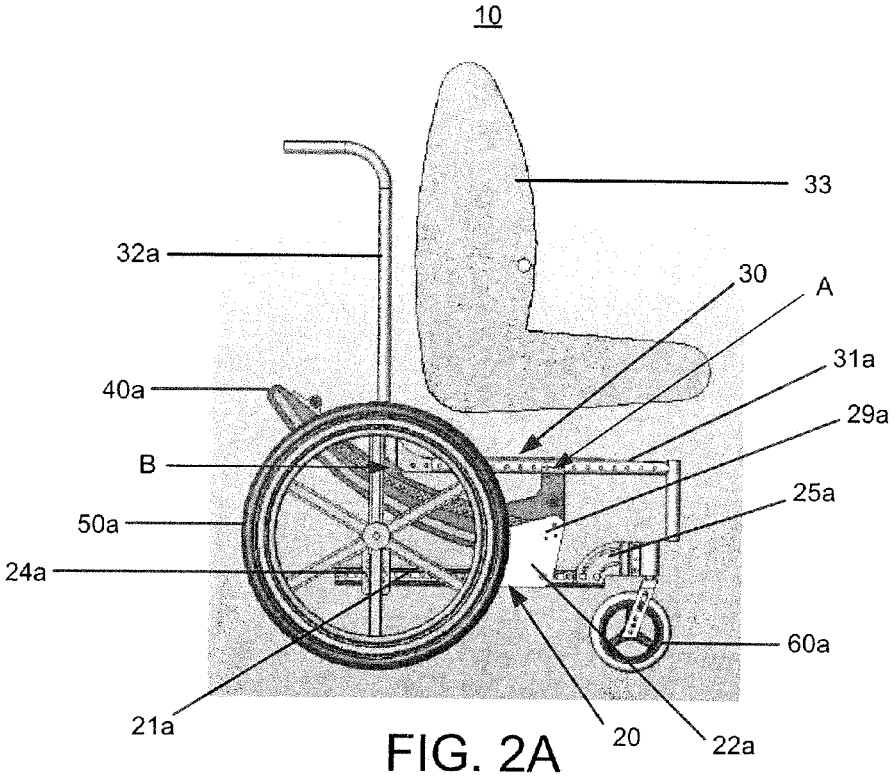
FIG. 2A shows a right side view of the wheelchair shown in FIG. 1.
Figure 2B:
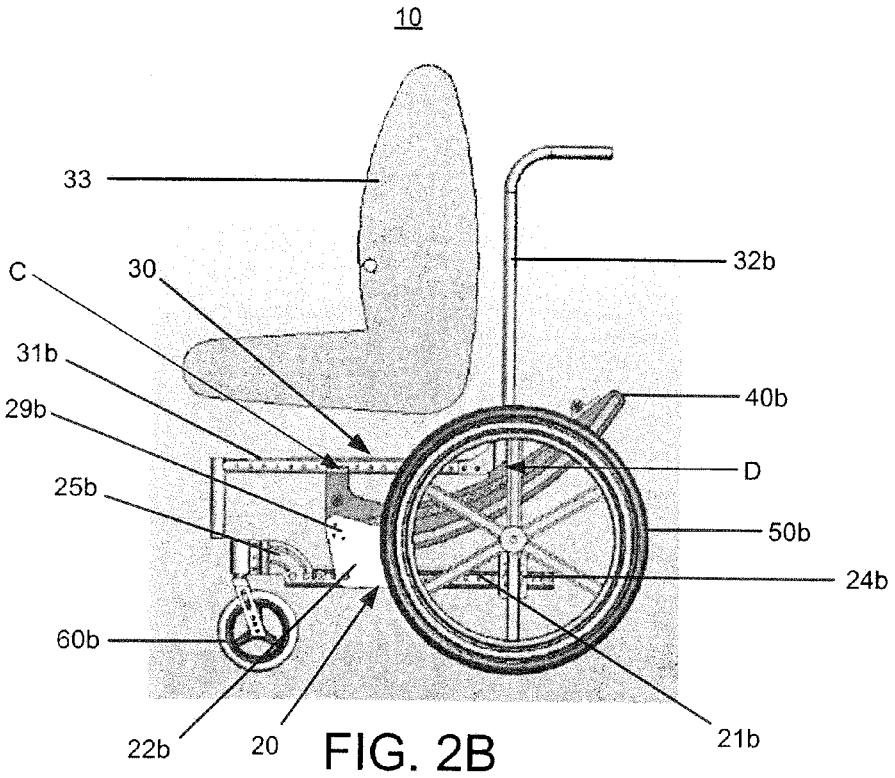
FIG. 2B shows a left side view of the wheelchair shown in FIG. 1.

As shown in the embodiment of FIGS. 1-2B, the main frame 20 may comprise side, main-frame tubes 21*a*, 21*b*, support plates 22*a*, 22*b*, rollers or slides 28*a*, 29*a*, 28*b*, 29*b*, axle plates 24*a*, 24*b*, and caster plates 25*a*, 25*b*. As shown, the side, main-frame tubes 21*a*, 21*b* are preferably disposed horizontally, parallel to the forward and rearward directions of travel of the wheelchair 10. Also, the side, main-frame tubes 21*a*, 21*b* each preferably have a series of holes 26*a*, 26*b* that are disposed along their longitudinal axis so that plates may be attached at different locations along their lengths. The support plates 22*a*, 22*b*, axle plates 24*a*, 24*b*, and caster plates 25*a*, 25*b* each have holes 27*a*, 27*b* that are adpated to be aligned with the holes 26*a*, 26*b* of the side, main-frame tubes 21*a*, 21*b* so that the plates may be fastened to the side, main-frame tubes 21*a*, 21*b*.

Figure 3A:
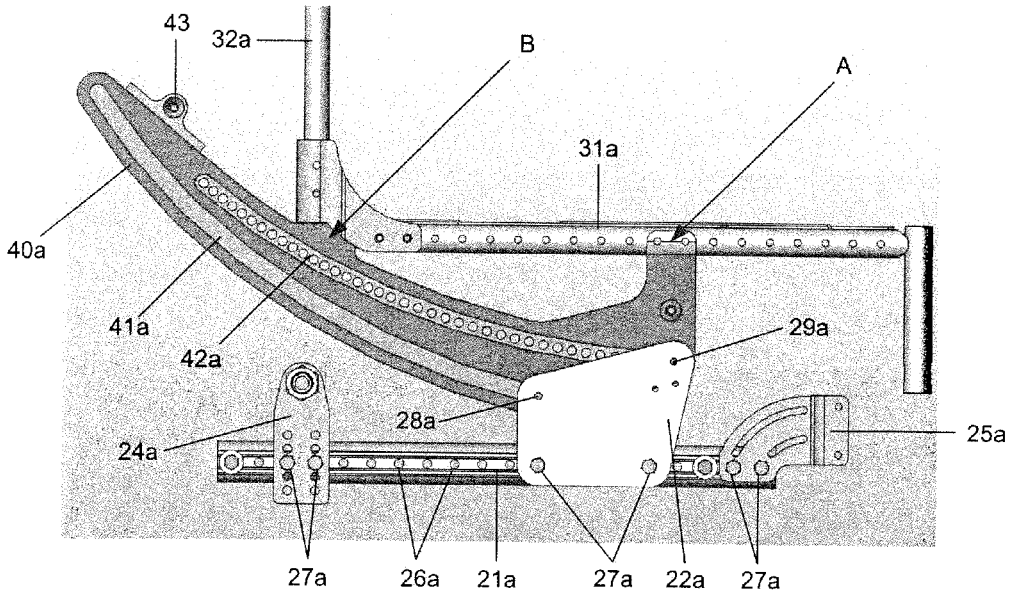
FIG. 3A shows a right side view of an exemplary seat frame supported on an exemplary main frame by an exemplary arc plate.
Figure 3B:
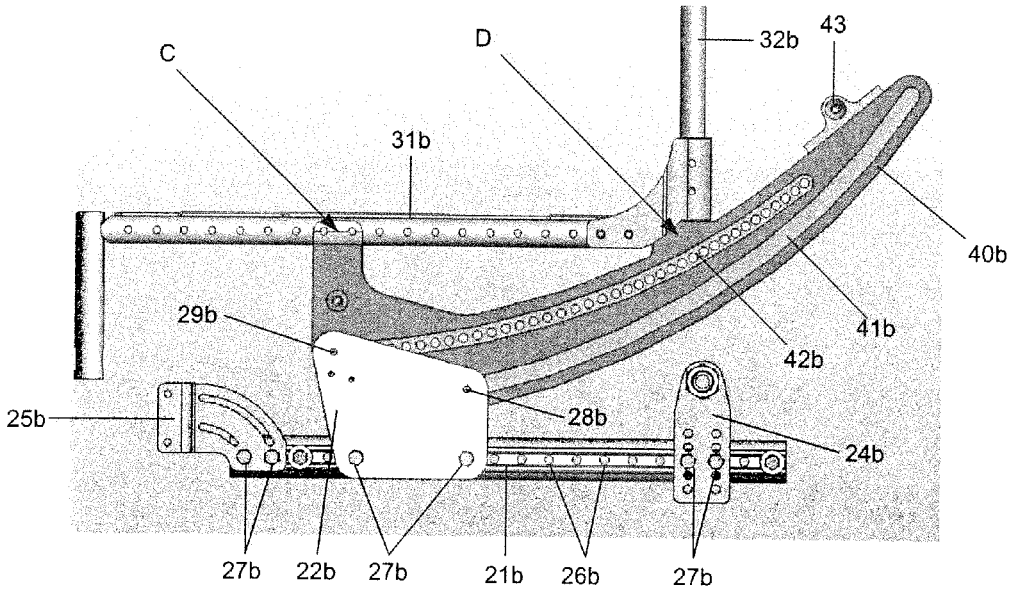
FIG. 3B shows a left side view of the seat frame, main frame, and arc plate shown in FIG. 3A.

As shown in FIG. 2A and 3A, the right side of the main frame 20 may be assembled by connecting the support plate 22*a*, axle plate 24*a*, and caster plate 25*a* to the side, main-frame tube 21*a*. The support plate 22*a*, axle plate 24*a*, and caster plate 25*a* may be connected to the side, main-frame tube 21 a by aligning the holes 27*a* of each of the plates with different holes 26*a* along the side, main-frame tube 21*a* and inserting fasteners through the holes 26*a*, 27*a*. Preferably, the axle plate 24*a* is rearwardly connected to the side, main-frame tube 21*a*, the caster plate 25*a* is forwardly connected to the side, main-frame tube 21*a*, and the support plate 22*a* is centrally connected to the side, main-frame tube 21 a. Similarly, the left side of the main frame 20 may be assembled to mirror the right side. As shown in FIG. 2B and 3B, the support plate 22*b*, axle plate 24*b*, and caster plate 25*b* are connected to the side, main-frame tube 21*b*. The support plate 22*b*, axle plate 24*b*, and caster plate 25*b* may be connected to the side, main-frame tube 21*b* by aligning the holes 27*b* of each of the plates with different holes 26*b* along the side, main-frame tube 21*b* and inserting fasteners through the holes 26*b*, 27*b*. Preferably, the axle plate 24*b* is rearwardly connected to the side, main-frame tube 21*b*, the caster plate 25*b* is forwardly connected to the side, main-frame tube 21*b*, and the support plate 22*b* is centrally connected to the side, main-frame tube 21*b*. The right and left sides of the main frame 20 may be spaced apart opposite and parallel to each other so that the right side mirrors the left side. Further, as shown in FIG. 1, the right and left sides of the main frame 20 are preferably connected to each other by one or more cross, main-frame tubes 23 that are attached transversely to the side, main-frame tubes 21*a*, 21*b*.

As shown in FIGS. 2A-2B, wheels 50*a*, 50*b* may be mounted on the axle plates 24*a*, 24*b* and caster wheels 60*a*, 60*b* may be mounted on the caster plates 25*a*, 25*b*. Thus, the main frame 20 can be supported and rolled on a generally planar surface by the wheels 50*a*, 50*b* and caster wheels 60*a*, 60*b*. As shown, the wheels 50*a*, 50*b* are preferably mounted rearward on the main frame 20 and the caster wheels 60*a*, 60*b* are preferably mounted forward on the main frame 20.

According to the embodiment of FIGS. 2A-2B, the seat frame 30 comprises side, seat-frame tubes 31*a*, 31*b*, back canes 32*a*, 32*b*, and a seat 33. The side, seat-frame tubes 31*a*, 31*b* are preferably disposed horizontally, parallel to the forward and rearward directions of travel of the wheelchair 10. The right side of the seat frame 30 includes a side, seat-frame tube 31*a* and a back cane 32*a* extending upwardly from the rear of the side, seat-frame tube 31*a*. The left side of the seat frame 30 includes a side, seat-frame tube 31*b* and a back cane 32*b* extending upwardly from the rear of the side, seat-frame tube 31*b*. The right and left sides of the seat frame 30 may be spaced apart opposite and parallel to each other so that the right side mirrors the left side. Further, as shown in FIG. 1, the right and left sides of the seat frame 30 are preferably connected to each other by a plate 34 attached transversely to the side, seat-frame tubes 3*l*a, 31*b*. The seat 30 may be attached to the side, seat-frame tubes 3*l*a, 31*b*, back canes 32*a*, 32*b*, and/or plate 34 to support an occupant on the wheelchair 10.

Figure 4:
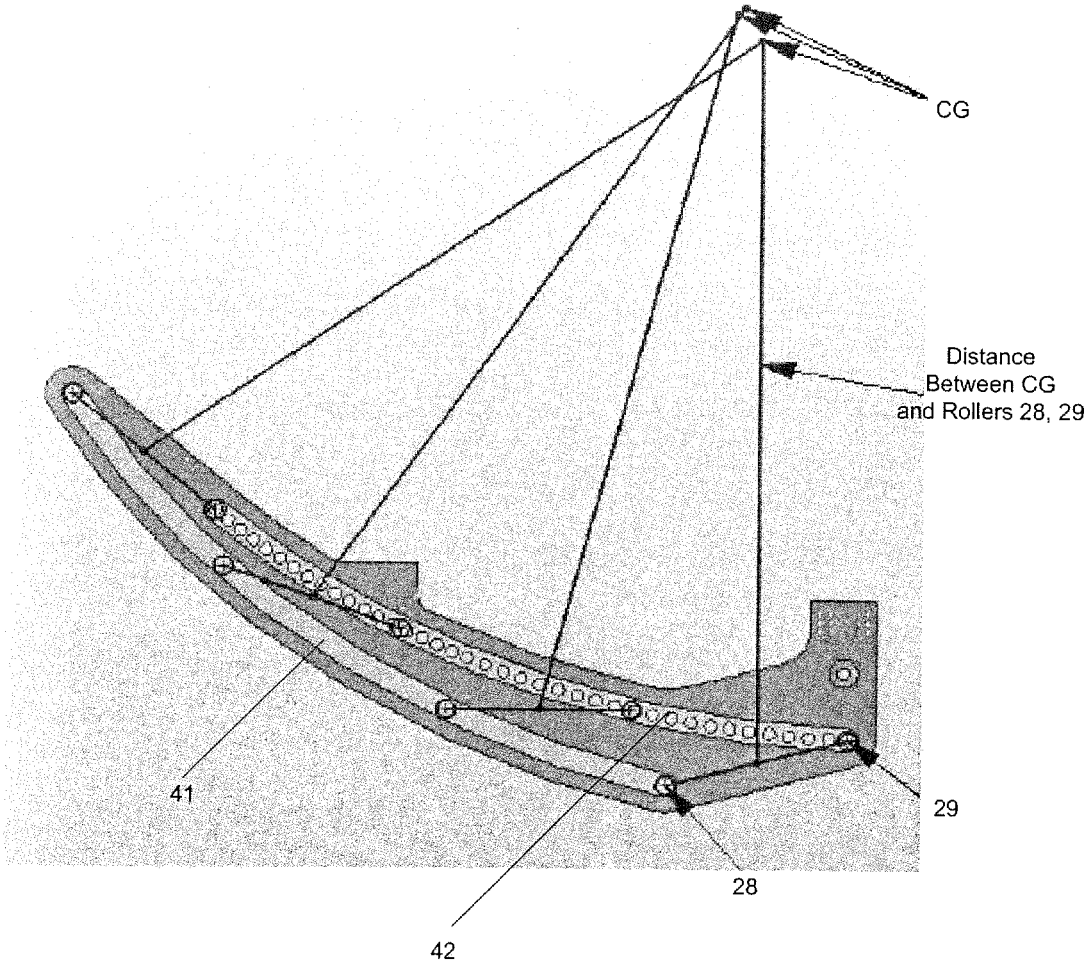
FIG. 4 shows a side view of another exemplary arc plate.

The seat frame 30 is slidably supported relative to the main frame 20 by at least one arc plate 40. Reference numeral 40 refers generally to an arc plate, and reference numerals 40*a* and 40*b* refer more specifically to a right arc plate 40*a* and a left arc plate 40*b*. As shown, the same reference numerals refer to the same elements and letters a and b designate whether the element corresponds to the right arc plate 40*a* or left arc plate 40*b*, respectively. Although seat frame 30 is shown supported relative to the main frame by two arc plates 40*a*, 40*b*, the design of the present invention may be modified to include only one arc plate or more than two arc plates having the same structure as arc plate 40 located anywhere on the wheel chair, without deviating from the objective of the present invention. As shown in FIGS. 4, each arc plate 40 defines a first track 41 and a second track 42. Although the present invention is herein described as comprising a first track 41 and a second track 42, it is understood by those skilled in the art that the present invention may instead be adapted to incorporate a first rail and a second rail without deviating from the objective of the present invention.

According to the embodiment shown in FIGS. 3A-4, the first 41 and second 42 tracks preferably have non-constant curvatures, and more preferably, have curvatures comprising at least two radii of curvature. As shown, the first 41 and second 42 tracks preferably are positioned non-concentrically with respect to each other. In other words, the focal point of a portion of the first track 41 does not coincide with the focal point of a corresponding portion of the second track 42. Thus, the first 41 and second 42 tracks may be arranged so that the spacing between them varies along their lengths. Additionally, although not necessary, the first 41 and second 42 tracks preferably have the same curvature and overall length. According to another embodiment (not shown), the first 41 and second 42 tracks preferably have a constant curvature and are arranged non-concentrically with respect to each other so that the focal point of the first track 41 does not coincide with the focal point of the second track 42. Thus, the first 41 and second 42 tracks may be arranged so that the spacing between them varies along their lengths. Additionally, although not necessary, the first 41 and second 42 tracks preferably have the same curvature and overall length.

According to the embodiment shown in FIGS. 2A-3B, the right side of the seat frame 30 may be supported relative to the right side of the main frame 20 by arc plate 40*a*. As shown, arc plate 40*a* is attached to the side, seat-frame tube 31 a at points A and B, which can be accomplished by any conventional means, such as welding, fastening, etc. The first 41 a and second 42*a* tracks of the arc plate 40*a* slidably or rollably engage the support plate 22*a*. Preferably, as shown in FIG. 3A, the support plate 22*a* has two rollers or sliders 28*a*, 29*a* that are spaced apart and adapted to engage the first 41 a and second 42*a* tracks of the arc plate 40*a*, respectively. The two rollers or sliders 28*a*, 29*a* are spaced apart to prevent binding of the first 41 a and second 42*a* tracks as the arc plate 40*a* moves relative to the main frame 20. Similarly, the left side of the seat frame 30 may be connected and supported relative to the left side of the main frame 20 by arc plate 40*b*. As shown, arc plate 40*b* is attached to the side, seat-frame tube 31*b* at points C and D, which can be accomplished by any conventional means, such as welding, fastening, etc. The first 41*b* and second 42*b* tracks of the arc plate 40*b* slidably or rollably engage the support plate 22*b*. Preferably, as shown in FIG. 3B, the support plate 22*b* has two rollers or sliders 28*b*, 29*b* that are spaced apart and adapted to engage the first 41*b*and second 42*b* tracks of the arc plate 40*b*, respectively. The two rollers or sliders 28*b*, 29*b* are spaced apart to prevent binding of the first 41 b and second 42*b* tracks as the arc plate 40*b* moves relative to the main frame 20. As shown in FIG. 1, the arc plates 40*a*, 40*b* are disposed opposite and parallel to each other and are connected by a cross tube 43.

Thus, the seat frame 30 is attached to the arc plates 40*a*, 40*b* and is designed to tilt by allowing the first 41*a*, 41*b* and second 42*a*, 42*b* tracks of the arc plates 40*a*, 40*b* to slide along the rollers or sliders 28*a*, 29*a*, 28*b*, 29*b* disposed on the support plates 22*a*, 22*b* of the main frame 20. The structure and arrangement of the first 41*a*, 41*b* and second 42*a*, 42*b* tracks in accordance with the present invention provide at least two advantages. First, a predetermined amount of tilt may be achieved with shorter tracks than would be possible with conventional track structures and arrangements. This allows for a more compact wheelchair design. Second, the structure and arrangement of the first 41*a*, 41*b* and second 42*a*, 42*b* tracks may be adjusted to limit the shift of an occupant's center of gravity during tilting of the seat 33. This allows for a wheelchair design that limits the possibility of startle reflex during tilting for a variety of occupants having different centers of gravity. These advantages are not intended to be limiting.

The first 41 and second 42 tracks are preferably positioned non-concentrically so that the spacing between them varies along their lengths. For example, the spacing between tracks 41 and 42 at any point may be measured normal from a tangent at either track. The tilt of the seat frame 30 relative to the main frame 20 is caused by the fact that the spacing between the rollers 28, 29 is fixed and the rollers 28, 29 travel along a first track 41 and a second track 42, respectively, that have varying spacing between them. Additionally, the curvature of the first track 41 and second track 42 may be made different and/or non-constant to produce further tilting of the seat frame 30 relative to the main frame 20. As a result, the curvature and spacing of the first 41 and second 42 tracks may be adjusted to achieve a predetermined amount of tilt over a shorter length of track. Further, the curvature and spacing of the first 41 and second 42 tracks of the arc plate 40 may be adjusted to limit the shifting of the center of gravity of an occupant for a predetermined amount of tilt. FIG. 4 shows one embodiment of an arc plate 40 and the shift of the center of gravity (CG) of an occupant at various degrees of tilt.

Although the arc plate 40 is shown attached to the side, seat-frame tube 31, the design of the present invention may be modified to have the arc plate 40 attached to the side, main-frame tube 21 without deviating from the objective of the present invention. In this embodiment, the support plates 22*a*, 22*b* may be attached to the side, seat-frame tubes 31*a*, 31*b* so that the rollers or sliders 28*a*, 29*a*, 28*b*, 29*b* of the support plates 22*a*, 22*b* may slide along the first 41*a*, 41*b* and second 42*a*, 42*b* tracks of the arc plates 40*a*, 40*b* attached to the main frame 20. Thus, the seat frame 30 may slide relative to both the arc plates 40*a*, 40*b* and main frame 20.

What is claimed:

1. A wheelchair comprising:

a main frame a plurality of wheels adapted to support the main frame relative to a supporting surface;

a seat frame for supporting an occupant; and an arc plate adapted to support the seat frame relative to the main frame, the arc plate defining a first track and a second track positioned above a substantial portion of the first track, the first and second tracks serve as rolling or sliding surfaces that allow the seat frame to tilt relative to the main frame, wherein the first and second tracks 1) have a curvature, and 2) are non-concentric with respect to each other, such that, the first and second tracks define a tilt path that limits shifting of the center of gravity of the occupant when the occupant is supported by the seat frame and the seat frame is tilted along the tilt path.

2. The wheelchair of claim 1, wherein the curvature of the first track and the curvature of the second track are the same.

3. The wheelchair of claim 1, wherein the first track and second track have a curvature comprising two radii of curvature.

4. The wheelchair of claim 1, wherein the length of the first track and the length of the second track are the same.

5. The wheelchair of claim 1, wherein the arc plate is attached to the seat frame.

6. The wheelchair of claim 5, further comprising a support plate attached to the main frame and adapted to slidably or rollably engage the arc plate.

7. The wheelchair of claim 6, further comprising two rollers disposed on the support plate, one of the two rollers adapted to engage one of the first and second tracks, and the other of the two rollers adapted to engage the other of the first and second tracks.

8. The wheelchair of claim 1, wherein the arc plate is connected to the main frame.

9. The wheelchair of claim 8, further comprising a support plate connected to the seat frame and adapted to slidably or rollably engage the arc plate.

10. The wheelchair of claim 9, further comprising two rollers disposed on the support plate, one of the two rollers adapted to engage one of the first and second tracks and the other of the two rollers adapted to engage the other of the first and second tracks.

11. The wheelchair of claim 1, wherein the first and second tracks curve with respect to and toward respective first and second points that are located above the main frame.

12. A wheelchair comprising:

a main frame;

a plurality of wheels adapted to support the main frame relative to a supporting surface;

a seat frame configured to support an occupant; and an arc plate adapted to support the seat frame relative to the main frame, the arc plate defining a first curved track and a second curved track positioned above a substantial portion of the first curved track, the first and second curved tracks serve as rolling or sliding surfaces that allow the seat frame to tilt relative to the main frame, wherein the first curved track and the second curved track are spaced apart by a varying dimension along their lengths, such that, the first and second curved tracks define a tilt path that limits shifting of the center of gravity of the occupant when the occupant is supported by the seat frame and the seat frame is tilted along the tilt path.

13. The wheelchair of claim 12 further comprising a support plate having a first roller or slide movably engaged with the first curved track and a second roller or slide movably engaged with the second curved track.

14. The wheelchair of claim 13, further comprising two rollers disposed on the support plate, one of the two rollers adapted to engage one of the first and second curved tracks, and the other of the two rollers adapted to engage the other of the first and second curved tracks.

15. The wheelchair of claim 12, wherein the first and second curved tracks are curved with respect to respective first and second points that are located above the main frame.

16. The wheelchair of claim 12, wherein the arc plate is attached to the seat frame or the main frame.

* * * * *